US005718170A

United States Patent [19]

Watanabe

[11] Patent Number: 5,718,170

[45] **Date of Patent: *Feb. 17, 1998**

[54] PROCESS FOR PRODUCING AND PERFORATING AN AQUEOUS SOLVENT SOLUBLE STENCIL PRINTING SHEET

[75] Inventor: Hideo Watanabe, Tokyo, Japan

[73] Assignee: Riso Kagaku Corporation, Tokyo, Japan

[ * ] Notice: The term of this patent shall not extend beyond the expiration date of Pat. No. 5,709,146.

[21] Appl. No.: 625,772

[22] Filed: Mar. 29, 1996

Related U.S. Application Data

[63] Continuation of Ser. No. 301,609, Sep. 7, 1994, abandoned.

[30] Foreign Application Priority Data

Sep. 9, 1993 [JP] Japan ..... 5-224723

[51] Int. Cl.[6] ..... B41N 1/24

[52] U.S. Cl. ..... 101/128.21; 101/128.4

[58] Field of Search ..... 101/114, 127, 101/127.1, 128.21, 128.4, 129; 427/143, 273; 156/247, 289, 308.8, 344

[56] References Cited

U.S. PATENT DOCUMENTS

| | | | |
|---|---|---|---|
| 628,315 | 7/1899 | Haberstroh | 101/128.21 |
| 1,606,217 | 11/1926 | Gestetner | 101/128.21 |
| 4,304,836 | 12/1981 | Cheema et al. | 430/252 |
| 4,550,660 | 11/1985 | Sato et al . | 101/128.21 |
| 4,961,377 | 10/1990 | Bando et al. | 101/128.21 |
| 5,174,203 | 12/1992 | Maeda | 101/129 |

FOREIGN PATENT DOCUMENTS

| | | | |
|---|---|---|---|
| 108509 | 10/1983 | European Pat. Off. . | |
| 1801287 | 10/1967 | Germany . | |
| 115898 | 7/1984 | Japan | 101/128.4 |
| 60-067196 | 4/1985 | Japan . | |
| 12387 | 1/1986 | Japan | 101/128.4 |
| 12395 | 1/1986 | Japan | 101/128.21 |
| 62-173296 | 1/1986 | Japan . | |
| 21596 | 1/1987 | Japan | 101/128.4 |
| 173296 | 7/1987 | Japan | 101/127 |
| 255361 | 7/1926 | United Kingdom . | |

*Primary Examiner*—Stephen R. Funk

*Attorney, Agent, or Firm*—Fay, Sharpe, Beall, Fagan, Minnich & McKee

[57] ABSTRACT

A process for producing a stencil printing sheet by laminating a water-soluble resin layer formed on a non-adhesive substrate to a porous substrate with an adhesive or by heat adhesion. The non-adhesive substrate is removed from the water-soluble resin layer to obtain a stencil printing sheet. The water-soluble resin layer is perforated by a single application of an aqueous solvent onto the water-soluble resin layer, such that the solution which dissolves the water-soluble resin layer permeates into the interior of the porous substrate.

8 Claims, 1 Drawing Sheet

PROCESS FOR PRODUCING AND PERFORATING AN AQUEOUS SOLVENT SOLUBLE STENCIL PRINTING SHEET

This application is a continuation of Ser. No. 08/301,609, filed on Sep. 7, 1994, now abandoned.

BACKGROUND OF THE INVENTION

1. Field of the Invention

The present invention relates to a process for producing a stencil printing sheet. Specifically, it relates to a process for producing a stencil printing sheet having a solvent-soluble resin layer.

2. Description of the Prior Art

In the prior art, a heat-sensitive stencil sheet is known which is produced by laminating a thermoplastic resin film on a porous substrate with an adhesive. A stencil-making of this heat-sensitive stencil sheet is carried out by means of (1) a process of superposing a hand written or preliminarily prepared manuscript on a heat-sensitive stencil sheet and then perforating by melting a thermoplastic resin film using the heat generated from e.g. flash lamp, infrared lamp, (2) a process of bringing a thermal head which generates a dot-like heat in accordance with electrical signals from letter or picture information, in contact with a heat-sensitive stencil sheet, and perforating by melting a thermoplastic resin film of the sheet, and other processes.

However, according to the stencil-making process described above, it was necessary to experience a complicated process of bringing a manuscript heated by absorbing light or thermal head in contact with a heat-sensitive stencil sheet, conducting the heat to the thermoplastic resin film of a heat-sensitive stencil sheet to melt the thermoplastic resin film and then shrinking the molten material to perforate the thermoplastic resin film, the stencil-making process had the disadvantages in that, for example, (1) a perforating failure was produced by the contacting failure between a thermoplastic resin film and a manuscript which absorbed heat or thermal head; (2) a perforating failure was produced by the nonuniformity in press pressure of a thermal head, resulting in producing wrinkles in a heat-sensitive stencil sheet; (3) the molten material of a thermoplastic resin film was adhered to a thermal head, resulting in producing a conveying failure of heat-sensitive stencil sheet; and (4) since the molten material was left in a perforated portion, the ink permeability was prevented, resulting in printing failure.

In recent years, a further improvement in quality of heat-sensitive stencil sheet is demanded. It is demanded to provide such a heat-sensitive stencil sheet that satisfies the smoothness of a thermoplastic resin film, the separating property of the thermoplastic resin film from the manuscript or thermal head, the melting property due to heat and the shrinkability of a thermoplastic resin film heat, the adhesive strength between a thermoplastic resin film and a porous substrate, and the mechanical strength and abrasion of the porous substrate, and therefore, the condition for producing heat-sensitive stencil sheet becomes complicated and there was the problem that the production cost was accordingly increased.

SUMMARY OF THE INVENTION

It is a main object of this invention to solve the above-mentioned problems in the prior art and provide a process for producing a stencil printing sheet in which the production process is easy, the production cost can be lowered and there are no perforating failure at a time of stencil-making, no generation of wrinkles, no conveying failure and no printing failure.

The invention to be claimed mainly in this application will be as follows:

(1) A process for producing a stencil printing sheet comprising the steps of:

laminating a solvent-soluble resin layer formed on a nonadhesive substrate to a porous substrate with an adhesive or by heat-adhesion; and then removing said nonadhesive substrate from said solvent-soluble resin layer, to obtain a stencil printing sheet.

DETAILED DESCRIPTION OF THE INVENTION

Figure 1A:
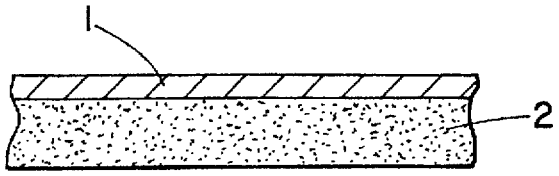
FIG. 1A, FIG. 1B and FIG. 1C show explanatory views showing steps in the process for producing a stencil printing sheet according to the present invention.

A solvent-soluble resin layer to be used in this invention is formed on a nonadhesive substrate and contains a thermoplastic or thermosetting resin soluble in water or an organic solvent and others as a main component.

As for an organic solvent-soluble resin, for example, polyethylene, polypropylene, polyisobutylene, polystyrene, polyvinyl chloride, polyvinylidene chloride, polyvinyl fluoride, polyvinyl acetate, acrylic resin, polyacrylonitrile, polyamide, polyimide, petroleum resin, phenolic resin, amino resin, epoxy resin, polyester, polycarbonate, polyurethane, polysulfone, silicone resin, alkyd resin, melamine resin or the like may be used. The resins may be used independently or in an admixture thereof. Copolymerized form of these resins may be used as well.

As for a water-soluble resin, a resin soluble in a water or in a water-miscible solvent, such as polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, polyacrylamide, starch, dextrin, alginic acid, ascorbic acid, water-soluble urethane or the like may be used. These resins may be used independently or in an admixture thereof. Copolymerized form of these resins may be used as well.

In addition to the above resin components, dyestuffs, pigments, fillers, binders, hardeners and others may be also contained in the resin layer described above.

The thickness of the resin layer formed on a nonadhesive substrate is preferably in the range of 0.1 μm–100 μm, and more preferably, in the range of 1 μm–50 μm. When the thickness thereof is less than 0.1 μm, the strength of the resin layer becomes insufficient and when it exceeds 100 μm, a large quantity of the solvent which dissolves the resin layer may be required and the perforation by dissolving the resin layer often becomes insufficient.

There is no particular limitation to the nonadhesive substrate to be used in the invention. For example, a silicone-treated separation sheet, polyester film, polytetrafluoroethylene sheet, polypropylene film and the like may be used.

A resin layer having a thin thickness and a weak mechanical strength can be laminated on a porous substrate easily by mounting the resin layer on a nonadhesive substrate in advance. When the thickness of the solvent-soluble resin layer to be laminated to the porous substrate is thin, an amount of the solvent to be used at a stencil-making time may be small and economical, the time required for stencil-making can be shortened and the handling of a resin layer having a weak mechanical strength at a production time thereof becomes easy. Furthermore, the surface characteristics of the resin layer can be altered by changing the surface property of the nonadhesive substrate. In the stencil-making and printing processes, when a nonadhesive substrate having a rough surface is used, the rough surface is transcribed on the solvent-soluble resin layer and as a result, various effects such as an improvement in conveying property at a time of stencil-making for stencil printing sheet and others can be obtained.

As for a porous substrate to be used in the invention, Japanese paper or the like, woven or nonwoven cloth, gauze or the like made from natural fiber such as Manila hemp, pulp, Mitsumata (*Edgeworthia papyrifera Sieb.*), Kozo (*Broussonetia kazinoki Sieb.*), synthetic fiber such as that of polyester, nylon, vinylon, acetate fiber or the like, a thin leaf paper using metallic fiber, glass fiber or the like, independently or as a mixture thereof, can be exemplified. Each basis weight of these porous substrate is preferably in the range of 1 $g/m^2$–20 $g/m^2$, and more preferably, in the range of 5 $g/m^2$–15 $g/m^2$. When each basis weight is less than 1 $g/m^2$, the strength of the sheet becomes weak, and when it exceeds 20 $g/m^2$, the ink permeability often becomes bad at a printing time. Also, the thickness of the porous substrate is preferably in the range of 5 μm–100 μm, and more preferably, in the range of 10 μm–50 μm. When the thickness is less than 5 μm, the strength of the sheet still becomes weak, and when it exceeds 100 μm, the ink permeability at a printing time often becomes bad.

Now, the detailed description of a process for producing stencil printing sheet according to this invention will be given in the following.

First of all, a resin solution is prepared by dissolving a solvent-soluble resin in a solvent. This solvent may be the same as or different from the solvent used for the stencil-making of stencil printing sheet which will be described later. However, from the viewpoint of production efficiency, it is preferable to use a readily drying solvent. The viscosity, surface tension and the like of the resin solution are properly controlled while taking the coating condition to a nonadhesive substrate into consideration.

Then, the above-mentioned resin solution is coated on the nonadhesive substrate by means of e.g. roller coater, photogravure coater, wire bar coater, reverse coater, and dried to form a solvent-soluble resin layer.

Subsequently, the solvent-soluble resin layer formed on the nonadhesive substrate is laminated to a porous substrate. As for a laminating process, a process (1) of using an adhesive and a process (2) of applying a heat-adhesion to a resin layer and a porous substrate, can be adapted.

In the case of the process (1), a solvent-soluble type or water-dispersion type adhesive is coated on a resin layer or porous substrate and then cured thermally or photolytically as to be laminated to each other. A heat-adhesion may be made using a hot-melt type adhesive to laminate to each other. As for an adhesive described above, the coated film after curing is preferably soluble in such a solvent that dissolves the resin layer described above. For example, epoxy resin, phenolic resin, vinyl acetate, ethylene-vinyl acetate copolymer, vinyl chloride-vinyl acetate copolymer, acrylic resin, polyester, polyurethane, styrene-butadiene copolymer, polyisobutylene, isoprene, butyl rubber, polyacrylamide, rosin, terpene, polystyrene or the like can be used. Also, a hardener, softener, adhesive adder, filler or the like may be mixed therewith, if necessary.

The process (2) can be adapted in the case when a thermally molten component is contained in a resin layer and/or a porous substrate. In this case, the resin layer is laminated to the porous substrate by means of a heating apparatus such as a heat roller and others.

Subsequently, the nonadhesive substrate laminated to the solvent-soluble resin layer is peeled off to give a stencil printing sheet.

Figure 1B:
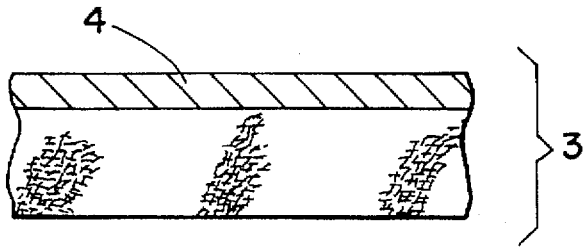
Figure 1C:
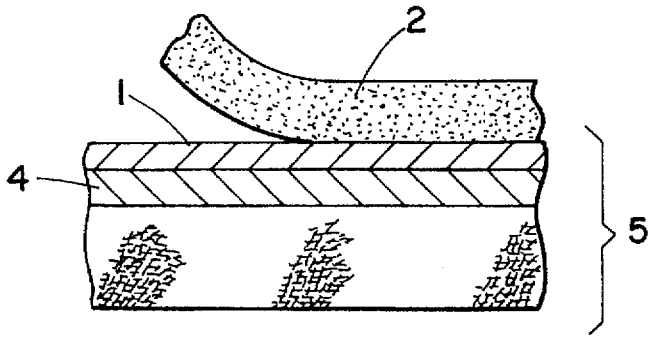

FIGS. 1A, 1B and 1C show a process for producing a stencil printing sheet using an adhesive. In FIG. 1A, a solvent-soluble resin layer 1 is formed on a nonadhesive substrate 2, and in FIG. 1B, a porous substrate 3 is impregnated with an adhesive to form an adhesive layer 4. In FIG. 1C, the adhesive layer 4 is laminated to the above solvent-soluble resin layer 1 and after then, the nonadhesive substrate 2 is removed from the solvent-soluble resin layer 1.

Since the above stencil printing sheet has a solvent-soluble resin layer, in the case of bringing it in contact with a solvent which dissolves the resin layer, the resin in its contact portion starts dissolving into the solvent, and the resin dissolves into the solvent up to its saturation in solubility. The solution which dissolved the resin permeates into a porous substrate and the resin layer corresponding to this portion is perforated. Since the solution which was dissolved in the resin layer permeates into the porous substrate, the dissolved component is not left in the perforated portion of the resin layer and does not obstruct the perforation. In addition, the perforating property of the resin layer can be adjusted by controlling the solubility of the solvent to the resin layer and the quantity of the contacting solvent.

As for a solvent which dissolves the solvent-soluble resin layer, each type solvent, such as aliphatic hydrocarbons, aromatic hydrocarbons, alcohols, ketones, esters, ethers, aldehydes, carboxylic acids, carboxylic esters, Mines, low molecular heterocyclic compounds, oxides or water, can be exemplified. Specifically, hexane, heptane, octane, benzene, toluene, xylene, methyl alcohol, ethyl alcohol, isopropyl alcohol, n-propyl alcohol, butyl alcohol, ethylene glycol, diethylene glycol, propylene glycol, glycerine, acetone, methyl ethyl ketone, ethyl acetate, propyl acetate, ethyl ether, tetrahydrofuran, 1,4-dioxane, formic acid, acetic acid, propionic acid, formaldehyde, acetaldehyde, methylamine, ethylenediamine, dimethyl formamide, pyridine, ethylene oxide and the like are preferable. These solvents can be used independently or in an admixture thereof. Furthermore, dyestuffs, pigments, fillers, binders, hardeners, antiseptics, wetting agents, surfactants, pH conditioners and others can be contained in the solvent.

Figure 2:
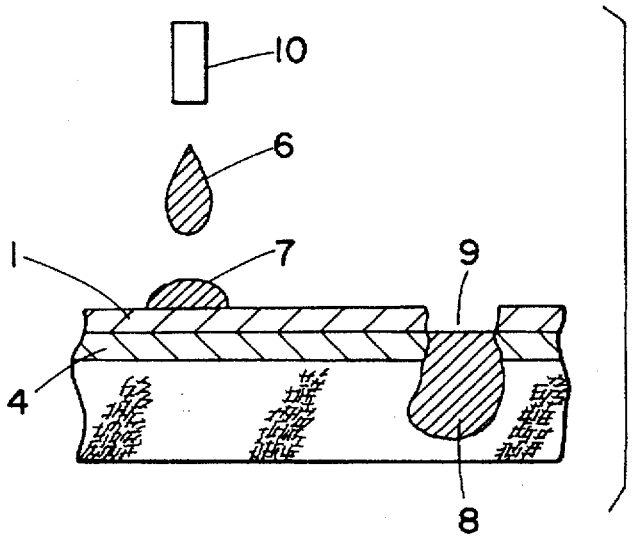
FIG. 2 is an explanatory view showing a perforation in a stencil printing sheet obtained by the process of the present invention.

FIG. 2 shows an explanatory view of a process for stencil-making using the above stencil printing sheet. In the drawing, a solvent 6 is ejected from a solvent ejecting means 10 and brought in contact with the surface of the solvent-soluble resin layer 1 of a stencil printing sheet 5. A contacting solvent 7 dissolves the resin and adhesive layer 4 in the contacted portion. The dissolving solution 8 permeates into the interior of the porous substrate to perforate the contacted portion. Numeral 9 shows a perforated resin layer.

As for a solvent feed process, it may be carried out by bringing a means, such as a brush pen immersed into a solvent, in contact with a solvent-soluble resin layer directly, but it is preferable to feed the solvent to the resin layer in a non-contact condition by a solvent ejecting device or the like.

As for this kind of solvent ejecting device, there is exemplified such an apparatus that a nozzle, a slit, an injector, a porous material, a porous film or the like is connected to a liquid feed pump, a piezoelectric element or a heating element so as to release the solvent intermittently or continuously in a dot or in a line pattern corresponding to each letter and picture signal. Since this kind of process makes it possible to carry out the stencil-making of stencil printing sheet in a non-contact condition with a stencil-making apparatus, there is no generation of wrinkles at a time of stencil-making. Also, differently from a conventional heat-sensitive stencil sheet, no molten material is left in the perforated portion and a brilliant printed matter can be obtained.

Furthermore, the stencil printing sheet of the invention can be produced easily without any needs of separating property, abrasion and mechanical strength as required in the conventional heat-sensitive stencil sheet.

The stencil printing sheet obtained by the process of the invention can be applied to a general stencil printing process to obtain a printed matter. For example, a printed matter can be obtained by mounting an ink on a perforated stencil printing sheet, passing the ink through each portion perforated by press rolls, reduced pressure means or squeegee rolls, and transcribing the ink to a printing paper. As a printing ink, an oily ink usually used in stencil printing, water-base ink, water-in-oil emulsion ink, oil-in-water emulsion ink, and others can be used.

The detailed description of the present invention will be given more specifically with reference to examples in the following. It should be understood, however, that these examples do not limit the scope of the present invention.

EXAMPLE 1

(1) Production of Stencil Printing Sheet

A resin solution consisting of the following composition was coated by a roller coater on a silicone-treated separation sheet and dried to form a solvent-soluble resin layer of 3 μm in thickness thereon.

| | |
|---|---|
| Vinyl chloride-vinyl acetate copolymer | 20 parts by weight |
| Toluene | 50 parts by weight |
| Methyl ethyl ketone | 30 parts by weight |

Then, after an adhesive solution consisting of the following composition was coated on a Japanese paper having a basis weight of 12 g/m$^2$ and dried, the resulting adhesive layer of the Japanese paper was superposed to a solvent-soluble resin layer formed on the separation sheet obtained as described above, and then laminated to it by a press roller under a nip pressure of 2 kg/cm$^2$.

| | |
|---|---|
| Isoprene adhesive (solid content 40% by weight) | 50 parts by weight |
| Toluene | 50 parts by weight |

Subsequently, the separation sheet was removed from the solvent-soluble resin layer to give a stencil printing sheet.

(2) Stencil-Making of Stencil Printing Sheet

A mixed solvent consisting of the following composition was ejected in a letter shape on the surface of a solvent-soluble resin layer of the stencil printing sheet described above from a solvent ejecting means comprising a nozzle of 8 dots/mm and a piezoelectric element, connected thereto, and the resin layer at the ejecting portion was dissolved with the mixed solvent to perforate it.

| | |
|---|---|
| Toluene | 50 parts by weight |
| 1,4-dioxane | 30 parts by weight |
| methyl isobutyl ketone | 20 parts by weight |

(3) Stencil Printing

A black water-in-oil emulsion ink was mounted on the Japanese paper of the perforated sheet described above and then superposed on a printing paper to carry out a stencil printing by means of a portable stencil printing device (PRINT GOKKO PG-10, trademark of Riso Kagaku Corporation), resulting in printing brilliantly the letters corresponding to the perforated portions.

EXAMPLE 2

(1) Production of Stencil Printing Sheet

A resin solution consisting of the following composition was coated by a roller coater on a tetrafluoroethylene sheet of 30 μm in thickness and then dried to form a solvent-soluble resin layer of 2 μm in thickness thereon.

| | |
|---|---|
| Polyester resin | 15 parts by weight |
| Toluene | 50 parts by weight |
| Ethyl acetate | 35 parts by weight |

Then, after the similar adhesive solution as shown in Example 1 was coated on the Japanese paper having a basis weight of 12 g/m$^2$ and dried, the solvent-soluble resin layer formed on the above tetrafluoroethylene sheet was superposed and laminated to it. Subsequently, the tetrafluoroethylene sheet was removed from the resin layer to give a stencil printing sheet.

(2) Stencil-Making by Stencil Printing Sheet and Stencil Printing

A mixed solvent consisting of the following composition was ejected in a letter shape on the surface of the solvent-soluble resin layer of the stencil printing sheet described above from the similar ejecting means as shown in Example 1, and the resin layer of the ejected portion was dissolved with the mixed solvent to perforate the stencil printing sheet. In the similar manner as shown in Example 1, this perforated stencil printing sheet was printed, resulting in obtaining a good printed matter.

| | |
|---|---|
| Toluene | 50 parts by weight |
| Isopropyl alcohol | 20 parts by weight |
| Methyl ethyl ketone | 30 parts by weight |

EXAMPLE 3

(1) Production of Stencil Printing Sheet

A resin solution consisting of the following composition was coated by a reverse coater on a silicone-treated polyester film of 30 μm in thickness and dried to form a solvent-soluble resin layer of 3 μm in thickness thereon.

| | |
|---|---|
| Polyethylene oxide | 15 parts by weight |
| Isopropyl alcohol | 15 parts by weight |
| Water | 70 parts by weight |

Then, after a polyester fiber cloth having a sieve opening of 300 mesh was immersed in an adhesive solution consisting of the following composition, it was taken out and dried. The solvent-soluble resin layer formed on the polyester film described above was superposed and laminated to the surface of this polyester cloth and left in a thermostat over night.

| | |
|---|---|
| Acrylic resin | 20 parts by weight |
| Isocyanate | 5 parts by weight |
| Toluene | 45 parts by weight |
| Ethyl acetate | 30 parts by weight |

Subsequently, the resulting polyester film was removed from the resin layer to give a stencil printing sheet.

(2) Stencil-Making by Stencil Printing Sheet and Stencil Printing

Then, the ink in the ink jet printer was replaced with a mixed solvent consisting of the following composition, and the mixed solvent was ejected from the nozzle of the ink jet printer to the stencil printing sheet described above corresponding to the letters and pictures composed by a personal computer. The resin layer at the ejected portion was dissolved to perforate the stencil printing sheet.

| | |
|---|---|
| Isopropyl alcohol | 30 parts by weight |
| Diethylene glycol | 10 parts by weight |
| Water | 60 parts by weight |

A black offset ink was mounted on the polyester fiber cloth of the stencil printing sheet of stencil-making described above and this was superposed on the printing paper. When the ink was squeezed by a blade, the brilliant letters and pictures in similar to those recorded by the in k jet printer could be obtained.

EXAMPLE 4

(1) Production of Stencil Printing Sheet

A resin solution consisting of the following composition was coated by a reverse coater on a polypropylene film of 40 μm in thickness and then, dried to form a solvent-soluble resin layer of 3 μm in thickness thereon.

| | |
|---|---|
| Polyvinyl ether | 15 parts by weight |
| Methyl alcohol | 15 parts by weight |
| Water | 70 parts by weight |

Then, a polyester fiber cloth having a sieve opening of 300 mesh was superposed on the polyvinyl ether resin layer of the polypropylene film described above and laminated to it by passing the polypropylene film through heat rollers at 120° C. Subsequently, the resulting polypropylene film was removed from the resin layer to give a stencil printing sheet.

(2) Stencil-making by Stencil Printing Sheet and Stencil Printing

In the similar manner as shown in Example 3, stencil-making and printing operations were carried out using the stencil printing sheet described above to give a good printed matter.

EFFECTIVENESS OF THE INVENTION

According to the production process of the invention, as a solvent-soluble resin layer having a thin thickness can be laminated to a porous substrate, the resulting production costs can be reduced. That is, the resin layer is laminated on a nonadhesive substrate in advance, a resin layer having a thin thickness and a weak strength can be used. Thus, an amount of the solvent and a time for the stencil-making can be saved. Since the stencil printing sheet obtained by the production process of the invention can be perforated by a solvent in its non-contact condition, there is no generation of any perforating failure at a time of stencil-making, any wrinkles and conveying failure, resulting in obtaining brilliantly printed pictures thereby.

What I claim is:

1. A process for producing a stencil printing sheet comprising the steps of:

laminating a water-soluble resin layer formed on a nonadhesive substrate to a porous substrate with an adhesive or by heat-adhesion;

removing said nonadhesive substrate from said water-soluble resin layer, to obtain the stencil printing sheet;

perforating the water-soluble resin layer by a single application of an aqueous solvent onto the water-soluble resin layer; and permeating the aqueous solvent, which perforated the water-soluble resin layer, into an interior of the porous substrate whereby said aqueous solvent is retained therein.

2. A process for producing a stencil printing sheet according to claim 1, wherein said water-soluble resin is selected from polyvinyl alcohol, polyethylene oxide and polyvinyl ether, polyvinyl acetal.

3. A process for producing a stencil printing sheet according to claim 1, wherein said resin layer has a thickness in the range of 0.1 to 100 μm.

4. A process for producing a stencil printing sheet according to claim 1, wherein said porous substrate is selected from a polyester fiber cloth or a Japanese paper having a basis weight in the range of 1 to 20 g/m$^2$ and a thickness in the range of 5 to 100 μm.

5. A process for producing a stencil printing sheet comprising the steps of:

laminating a water-soluble resin layer formed on a nonadhesive substrate to a porous substrate with an adhesive or by heat-adhesion;

removing said nonadhesive substrate from said water-soluble resin layer, to obtain the stencil printing sheet;

perforating said water-soluble resin layer by a single application of an aqueous solvent onto the water-soluble resin layer, wherein the aqueous solvent which perforates said water-soluble resin layer permeates into an interior of the porous substrate; and controlling the solubility of the solvent to the resin layer, and the quantity of the contacting solvent so that the solvent is retained within the substrate.

6. A process for producing a stencil printing sheet according to claim 5, wherein said water-soluble resin is selected from polyvinyl alcohol, polyethylene oxide and polyvinyl ether, polyvinyl acetal.

7. A process for producing a stencil printing sheet according to claim 5, wherein said resin layer has a thickness in the range of 0.1 to 100 μm.

8. A process for producing a stencil printing sheet according to claim 5, wherein said porous substrate is selected from a polyester fiber cloth or a Japanese paper having a basis weight in the range of 1 to 20 g/m$^2$ and a thickness in the range of 5 to 100 μm.

* * * * *